169-46 SR
5/12/87 OR 4,664,199

United States Patent [19]

Grant et al.

[11] Patent Number: 4,664,199

[45] Date of Patent: May 12, 1987

[54] METHOD AND APPARATUS FOR EXTINGUISHING FIRES IN FLAMMABLE LIQUID FILLED STORAGE VESSELS

[75] Inventors: Casey C. Grant, Belmont; Parker Peterson, Westboro, both of Mass.

[73] Assignee: Kidde, Inc., Saddle Brook, N.J.

[21] Appl. No.: 813,414

[22] Filed: Dec. 26, 1985

[51] Int. Cl.[4] ..... A62C 1/24; A62C 3/12

[52] U.S. Cl. ..... 169/46; 169/66; 169/68

[58] Field of Search ..... 169/60, 66, 68, 46, 169/47

[56] References Cited

U.S. PATENT DOCUMENTS 1,912,458 6/1953 Mapes ..... 169/66 X
2,757,744 8/1957 Malone ..... 169/66 X
4,064,944 12/1977 McClure ..... 169/60

FOREIGN PATENT DOCUMENTS 742124 2/1933 France ..... 169/66
2259628 8/1975 France ..... 169/66

*Primary Examiner*—Andres Kashnikow
*Attorney, Agent, or Firm*—John E. Toupal; Harold G. Jarcho

[57] ABSTRACT

A method of extinguishing a fire burning above and fueled by a flammable liquid stored in a storage vessel and including the steps of providing a supply of a halogenated fire extinguishing agent, detecting the presence of combustion products above the surface of the flammable liquid, and discharging the extinguishing agent into the storage vessel and below the surface of the flammable liquid.

10 Claims, 5 Drawing Figures

METHOD AND APPARATUS FOR EXTINGUISHING FIRES IN FLAMMABLE LIQUID FILLED STORAGE VESSELS

BACKGROUND OF THE INVENTION

This invention relates generally to a method and apparatus for extinguishing fires and, more particularly, to a method and apparatus for extinguishing fires in storage vessels filled with flammable liquids.

Extinguishing fires in flammable liquid filled vessels is difficult because of the typically very volatile nature of the stored liquids. The techniques generally employed to extinguish such fires, often called tank fires, entail the discharge of an extinguishing agent onto the surface of the burning liquid. Usually, the fire extinguishing agent is released from a portable, manually operated extinguisher. Particularly for fires in large capacity storage tanks, the manual application of a fire extinguishing agent exhibits inconsistent effectiveness and presents the possibility of injury to fire fighting personnel. Those problems are somewhat alleviated with fixed extinguishing systems having electrical controls that are actuated either automatically in response to fire detection or manually by remotely positioned operators. However, fixed systems also exhibit certain disadvantages including the requirement for release of copious quantities of extinguishing agent to insure the presence thereof over the entire exposed surface of the flammable liquid. Even then, the deposition of extinguishing agent over the entire exposed surface of the flammable liquid is rendered difficult by the heavy turbulence inherently associated with fire. This difficulty is accentuated in tank installations having physical obstructions that inhibit the discharge of extinguishing agent onto all surface portions of the flammable liquid. Another problem is that the extinguishing agent, when discharged under pressure, can actually spread a fire by splashing burning fuel out of an open vessel.

Another technique previously suggested for extinguishing tank fires involved the release of $CO_2$ beneath the surface of the flammable liquid. According to the teachings of that technique, the released $CO_2$ would rise through the flammable liquid and extinguish a fire burning on its surface. A fire extinguishing method of that type is disclosed, for example, in U.S. Pat. No. 145,134. The subsurface release of $CO_2$ is impractical for large tank fires, however, because of the inherent condition that a majority of the released agent is absorbed by the flammable liquid. Therefore, most of the released $CO_2$ fails to reach the surface of the burning liquid and thereby function as an extinguishing agent. For those reasons excessive quantities of $CO_2$ must be used which is both inefficient and increases the possibility of fire spread due to splashing fuel.

The object of this invention, therefore, is to provide an improved method for extinguishing fires burning above and fueled by a flammable liquid stored in a storage vessel.

SUMMARY OF THE INVENTION

The present invention encompasses a method of extinguishing a fire burning above and fueled by a flammable liquid stored in a storage vessel and including the steps of providing a supply of a halogenated fire extinguishing agent, detecting the presence of combustion products above the surface of the flammable liquid, and discharging the extinguishing agent into the storage vessel and below the surface of the flammable liquid. The stored liquid absorbs very little of the halogenated agent, the majority of which rises to the surface of the liquid and chemically breaks the chain reaction of combustion to terminate the fire. Furthermore, the agent enters the fire at the fringe of the combustion wave where the burning velocity approaches zero, thereby minimizing the agent concentration required.

According to one feature of the invention, the extinguishing agent is stored as a liquified gas that is vaporized after fire detection so as to rise through the flammable liquid in a vapor phase. Vaporization of the liquified agent facilitates its ascension to the surface of the stored liquid.

According to yet another feature of the invention, the discharge network is a sparging network having discharge pipes with downwardly opening discharge openings and distributed through a horizontal cross-section of the storage vessel. The sparging network facilitates a prompt and uniform release of the extinguishing agent.

According to another feature of the invention, the extinguishing agent is bromotrifluoro methane also known by the generic name Halon-1301. Because Halon-1301 exhibits a liquid to vapor phase change at a very low temperature of −72° F., the advantageous vaporization of the agent is assured even in extremely cold environments.

The invention further encompasses a fire extinguishing system including a storage vessel retaining a flammable liquid, a container retaining a halogenated extinguishing agent, an agent discharge network disposed in the storage vessel below the surface of the flammable liquid, and a distribution network for distributing the extinguishing agent from the container to the discharge network for discharge thereby into the flammable liquid. Also included is a release mechanism for inducing the distribution of the extinguishing agent from the container to the discharge network, a detector for detecting combustion products above the surface of the flammable liquid, and a control means for activating the release mechanism in response to detection of combustion products by the detector. This system automatically provides the desired extinguishing method.

According to another feature, the halogenated extinguishing agent is a liquified gas that experiences a liquid to vapor phase change below 32° F., and the release mechanism comprises a valve opened in response to detection of combustion products by the detector. This feature facilitates vaporization of the agent for ascension through the stored liquid to the surface thereof.

DESCRIPTION OF THE DRAWINGS

These and other objects and features of the invention will become more apparent upon a perusal of the drawings wherein.

DESCRIPTION OF THE PREFERRED EMBODIMENT

Figure 2:
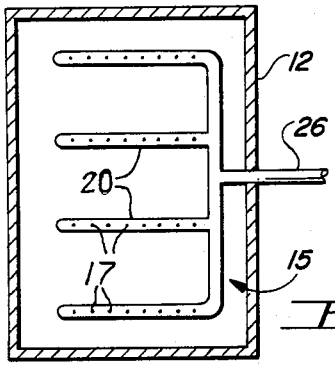
FIG. 2 is a schematic cross-sectional view taken along lines 2—2 of FIG. 1.

Illustrated in the drawing is a fire extinguishing system 11 according to the present invention. A storage vessel 12 is partially filled with a flammable liquid 13 such as oil. Mounted within the storage vessel 12 and below an exposed surface 14 of the flammable liquid 13 is an extinguishing agent sparging network 15. As shown in FIG. 2, the sparging network 15 includes a plurality of pipes 20 having downwardly opening discharge openings 17. The pipes 20 are arranged in a pattern corresponding to a horizontal cross section through the tank 12. A combustion products detector such as a continuous line type fire detector 16 extends around the entire inner surface of the vessel 12 above the exposed surface 14 of the liquid 13.

Located outside the vessel 12 is a hermetically sealed storage container 21. Retained by the container 21 is a liquified, halogenated extinguishing agent 22. Preferably the extinguishing agent 22 is bromotrifluoro methane (halon 1301) marketed, for example, by DuPont as Freon 13B1. Liquification of the extinguishing agent 22 within the container 21 is maintained by a pressurized inert gas 23 such as dry nitrogen. A release valve 24 is mounted on the top surface of the container 21 and communicates with a dip tube 25 that extends axially through the container 21 and opens into the lower portion thereof. Connected between the sparging network 15 and the valve 24 and providing fluid communication therebetween is a fluid distribution pipe 26.

A remote control interface 31 controls the operation of the extinguishing system 11. The control interface 31 receives an input from the fire detector circuit 16 on an input line 32 and an input from a manually operated actuator 33 on an input line 34. An output line 35 of the control interface 31 is operatively connected to the release valve 24 on the storage container 21. Another output line 36 of the control interface 31 is operatively connected to both an audible alarm 37 and a visual alarm 38.

OPERATION

In response to the detection of combustion products above the surface 14 of the flammable liquid 13, the detector 16 produces an output signal that is applied over the line 32 to the control interface 31. Resultant fire indicating output signals are provided by the control interface 31 on output lines 35 and 36. The output signal on line 36 actuates both the audible alarm 37 and the visual alarm 38 to indicate the presence of the fire detected by the detector 16. Simultaneously, the output signal on line 35 opens the valve 24 allowing the pressurized gas 23 in the container 21 to forcibly discharge the extinguishing agent 22 through the dip tube 25. After release from the pressurized container 21, the extinguishing agent 22 passes through the distribution pipe 26 and is discharged by the sparging network 15 into the body of flammable liquid 13 within the storage vessel 12. The released agent rises through the flammable liquid 13 and penetrates the surface 14.

Figure 4:
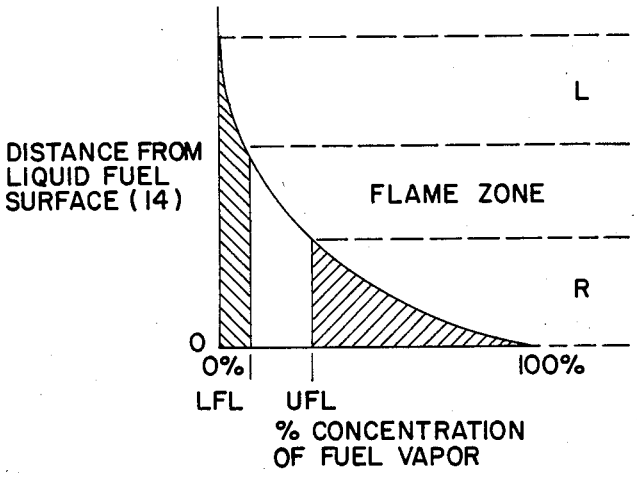
FIG. 4 is a schematic diagram illustrating the fuel fraction gradient in the fire of FIG. 3.
Figure 3:
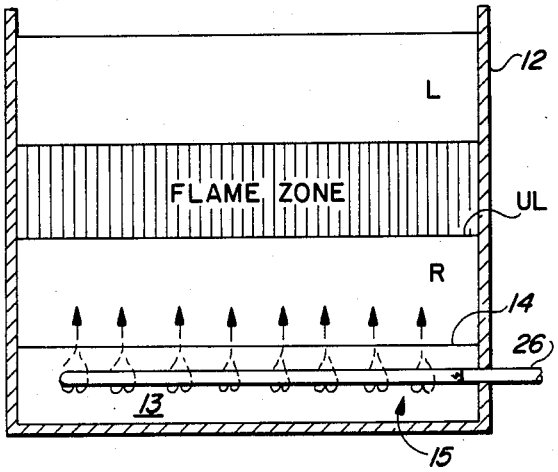
FIG. 3 is a schematic cross-sectional view taken along lines 3—3 of FIG. 2 and depicting the presence of a fire.

In order to support combustion, the liquid fuel 13 must undergo a liquid to vapor phase change. As shown in FIGS. 3 and 4, the fuel vapor forms above the liquid surface 14 a fuel rich volume R, a flame zone, and a fuel lean volume L. Thus, after penetrating the liquid surface 14, the released agent passes through the fuel rich volume R and enters the flame zone at the upper flammable limit UL. The agent enters, therefore, the reaction at the fringe of the combustion wave where the burning velocity approaches zero. Such fuel limit mixtures require the minimum concentrations of agent to break the chain reaction of combustion and extinguish flame.

Preferably, the halogenated agent 22 is a type that experiences a liquid to vapor phase change at a temperature below 32° F. A particularly desirable such agent is bromotrifluoro methane known as halon 1301. Halon 1301 experiences a liquid to vapor phase change at −72° F. and thereby insures that the agent will vaporize under even extremely cold environmental conditions and remain in the vapor state after discharge into the liquid 13. That factor is important in that a vaporized, halogenated agent will rise rapidly through the liquid 13 and the fuel rich volume R to reach the fire zone thereabove.

Figure 1:
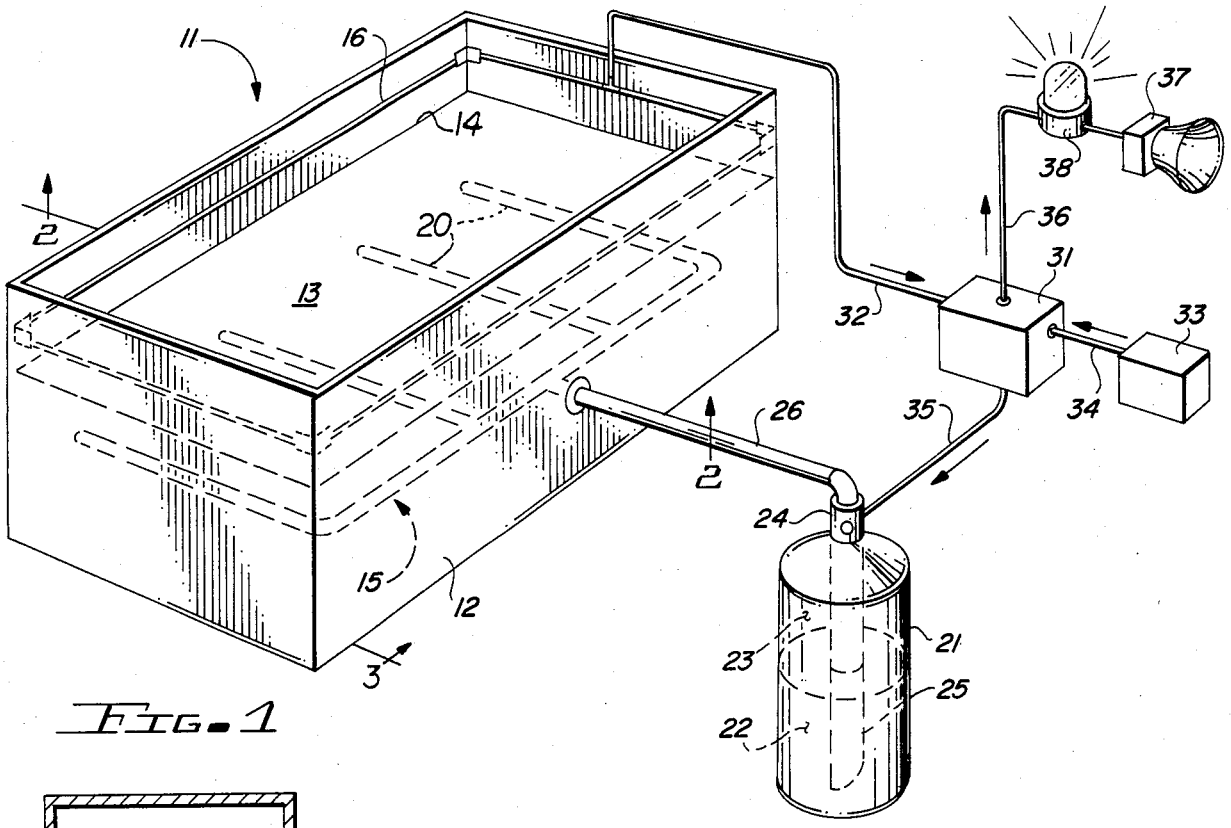
FIG. 1 is a schematic representation of a fire extinguishing system according to the invention.
Figure 5:
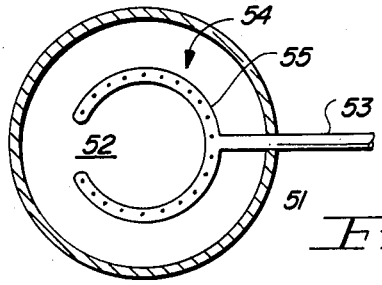
FIG. 5 is a schematic view illustrating a modified distribution network for the system shown in FIG. 1.

Another embodiment of the invention is illustrated in FIG. 5. In this embodiment a vessel 51 of cylindrical shape retains a liquid fuel 52. Entering the vessel 51 from a fire extinguishing system as shown in FIG. 1 is a distribution pipe 53 that is connected to a sparging network 54. In this case the sparging network consists of a circular discharge pipe 55 that conforms to a horizontal cross-section of the vessel 51 so as to provide uniform distribution of agent through downwardly oriented openings.

Obviously, many modifications and variations of the present invention are possible in light of the above teachings. For example only, combustion products detectors other than a heat detector 16 can be used. It is to be understood, therefore, that the invention can be practiced otherwise than as specifically described.

What is claimed:

1. A fire extinguishing system comprising:

a storage vessel;

a flammable liquid retained in said vessel;

a container means;

a halogenated, liquified gas extinguishing agent retained in said container means;

extinguishing agent discharge means disposed in said storage vessel below the surface of said flammable liquid;

distribution means for distributing said extinguishing agent from said container means to said discharge means for discharge thereby into said flammable liquid;

release means for inducing in said extinguishing agent a liquid to vapor change of state and distribution thereof from said container means to said discharge means;

detection means for detecting combustion products above the surface of said flammable liquid; and control means for activating said release means in response to detection of combustion products by said detection means.

2. A system according to claim 1 wherein said halogenated extinguishing agent experiences a liquid to vapor phase change below 32° F., and said release means comprises a valve opened in response to detection of combustion products by said detection means.

3. A system according to claim 2 wherein said halogenated extinguishing agent comprises bromotrifluoro methane.

4. A system according to claim 1 wherein said discharge means comprises a sparging network having discharge pipes distributed through a horizontal cross-section of said storage vessel.

5. A system according to claim 4 wherein said discharge pipes comprise downwardly opening discharge openings.

6. A system according to claim 5 wherein said halogenated extinguishing agent experiences a liquid to vapor phase change below 32° F., and said release means comprises a valve opened in response to detection of combustion products by said detection means.

7. A system according to claim 6 wherein said halogenated extinguishing agent comprises bromotrifluoro methane.

8. A method of extinguishing a fire burning above and fueled by a flammable liquid stored in a storage vessel and comprising the steps of providing a supply of a halogenated liquified gas fire extinguishing agent; detecting the presence of combustion products above the surface of said flammable liquid; inducing a liquid to vapor change of state in said agent; and discharging said extinguishing agent vapor into said storage vessel and below the surface of said flammable liquid.

9. A method according to claim 8 wherein said extinguishing agent is bromotrifluoro methane.

10. A method according to claim 9 wherein said extinguishing agent experiences a liquid to vapor phase change below 32° F.

* * * * *